US007726129B2

(12) United States Patent
Driver

(10) Patent No.: US 7,726,129 B2
(45) Date of Patent: Jun. 1, 2010

(54) STIRLING CYCLE ENGINE

(75) Inventor: Ronald William Driver, Chatburn (GB)

(73) Assignee: E.A. Technical Services Limited, Lancashire (GB)

( * ) Notice: Subject to any disclaimer, the term of this patent is extended or adjusted under 35 U.S.C. 154(b) by 0 days.

(21) Appl. No.: 11/628,779

(22) PCT Filed: Jun. 10, 2005

(86) PCT No.: PCT/GB2005/002317

§ 371 (c)(1),
(2), (4) Date: Sep. 6, 2007

(87) PCT Pub. No.: WO2005/124106

PCT Pub. Date: Dec. 29, 2005

(65) Prior Publication Data

US 2008/0072592 A1 Mar. 27, 2008

(30) Foreign Application Priority Data

Jun. 16, 2004 (GB) ..... 0413442.5

(51) Int. Cl.

| | |
|---|---|
| ***F01K 25/02*** | (2006.01) |
| ***F01K 27/00*** | (2006.01) |
| ***F16D 31/02*** | (2006.01) |
| ***F01B 29/08*** | (2006.01) |

(52) U.S. Cl. ..... 60/682; 60/398; 60/516; 60/641.1; 60/650

(58) Field of Classification Search ..... 60/495, 60/398, 516, 641.1, 650, 682
See application file for complete search history.

(56) References Cited

U.S. PATENT DOCUMENTS 3,762,376 A * 10/1973 Eberle et al. ..... 123/242

(Continued)

FOREIGN PATENT DOCUMENTS

FR 2 777 943 A1 10/1999

(Continued)

*Primary Examiner*—Thomas E Denion
*Assistant Examiner*—Christopher Jetton
(74) *Attorney, Agent, or Firm*—Baker & Hostetler LLP

(57) ABSTRACT

An intermediate duct (108) is connected between first and second positive displacement machines (104, 106). An inlet duct (107) is connected to the first positive displacement machine (104). An outlet duct (109) is connected to the second positive displacement machine (106). A heater (102) raises the temperature and pressure of a gaseous working fluid in the intermediate duct (108). There is a kinematic connection (111) between the first and second positive displacement machines (104, 106) and the arrangement is such that, in operation, the first positive displacement machine (104) causes the working fluid to flow through the intermediate duct (108) to the second positive displacement machine (106), the heated working fluid drives the second positive displacement machine (106), and the second positive displacement machine (106) drives the first positive displacement machine (104) via the kinematic connection (111). The positive displacement machines include at least one orbiting piston. The heater (102) is preferably constituted by a condenser in a heat pump circuit (101-103).

17 Claims, 8 Drawing Sheets

U.S. PATENT DOCUMENTS

| | | | | | |
|---|---|---|---|---|---|
| 3,902,546 | A | * | 9/1975 | Linhardt et al. | 165/240 |
| 4,362,014 | A | * | 12/1982 | Driver et al. | 60/39.43 |
| 4,759,324 | A | * | 7/1988 | Kita et al. | 123/216 |
| 4,831,827 | A | * | 5/1989 | Driver | 60/679 |
| 5,228,309 | A | | 7/1993 | McCullough | |
| 5,323,603 | A | * | 6/1994 | Malohn | 60/784 |
| 5,833,446 | A | * | 11/1998 | Smith et al. | 418/201.1 |
| 6,606,864 | B2 | * | 8/2003 | MacKay | 60/773 |
| 7,231,894 | B2 | * | 6/2007 | Driver | 123/43 R |
| 7,311,077 | B2 | * | 12/2007 | Driver | 123/237 |
| 2003/0226360 | A1 | | 12/2003 | Black | |
| 2004/0134853 | A1 | * | 7/2004 | Miller, III | 210/603 |

FOREIGN PATENT DOCUMENTS

| | | | |
|---|---|---|---|
| WO | WO 02/04787 | A2 | 1/2002 |
| WO | WO 02/04814 | A2 | 1/2002 |
| WO | WO 03/062604 | A2 | 7/2003 |
| WO | WO 2004/031539 | A1 | 4/2004 |

* cited by examiner

STIRLING CYCLE ENGINE

CROSS-REFERENCE TO RELATED APPLICATIONS

This is a national stage of International Application No. PCT/GB20051002317, filed on Jun. 10, 2005, which claims priority of Great Britain Patent Application No. 041344.5, filed Jun. 16, 2004, the disclosure of each application is hereby incorporated by reference in their entirety.

BACKGROUND OF THE INVENTION

1. Field of Invention

This invention relates to an engine, in particular an engine using the Stirling cycle.

2. Background Art

Many different designs of Sterling engine have been devised since the first Sterling engine was invented in 1816. It would be desirable to provide an engine which can make use of ambient heat or waste heat efficiently.

SUMMARY OF INVENTION

In one aspect the present invention provides a Stirling engine using at least one rotary positive displacement machine.

In another aspect the present invention provides a Stirling engine to which heat is supplied by a heat pump.

In particular, the invention provides an engine comprising: a first positive displacement machine; a second positive displacement machine; an inlet duct connected to the first positive displacement machine; an intermediate duct connected between the first and second positive displacement machines; an outlet duct connected to the second positive displacement machine; a heater for raising the temperature and pressure of a gaseous working fluid in the intermediate duct; and a kinematic connection between the first and second positive displacement machines. The arrangement is such that, in operation of the engine, the first positive displacement machine causes the working fluid to flow through the intermediate duct to the second positive displacement machine, the heated working fluid drives the second positive displacement machine, and the second positive displacement machine drives the first positive displacement machine via the kinematic connection.

The working fluid may be air or another gas. The preferred rotary positive displacement machines are those described in WO 02/04787, WO 02/04814, WO 03/062604, and WO 2004/031539, the disclosures of which are incorporated herein by reference. The heater may be constituted, at least in part, by a condenser of a heat pump utilizing any convenient heat source, such as air, water, earth (geothermal), waste heat, or combustion of gas or other fuel.

The invention will be described further, by way of example only, with reference to the accompanying drawings.

DETAILED DESCRIPTION OF PREFERRED EMBODIMENTS

Figure 1:
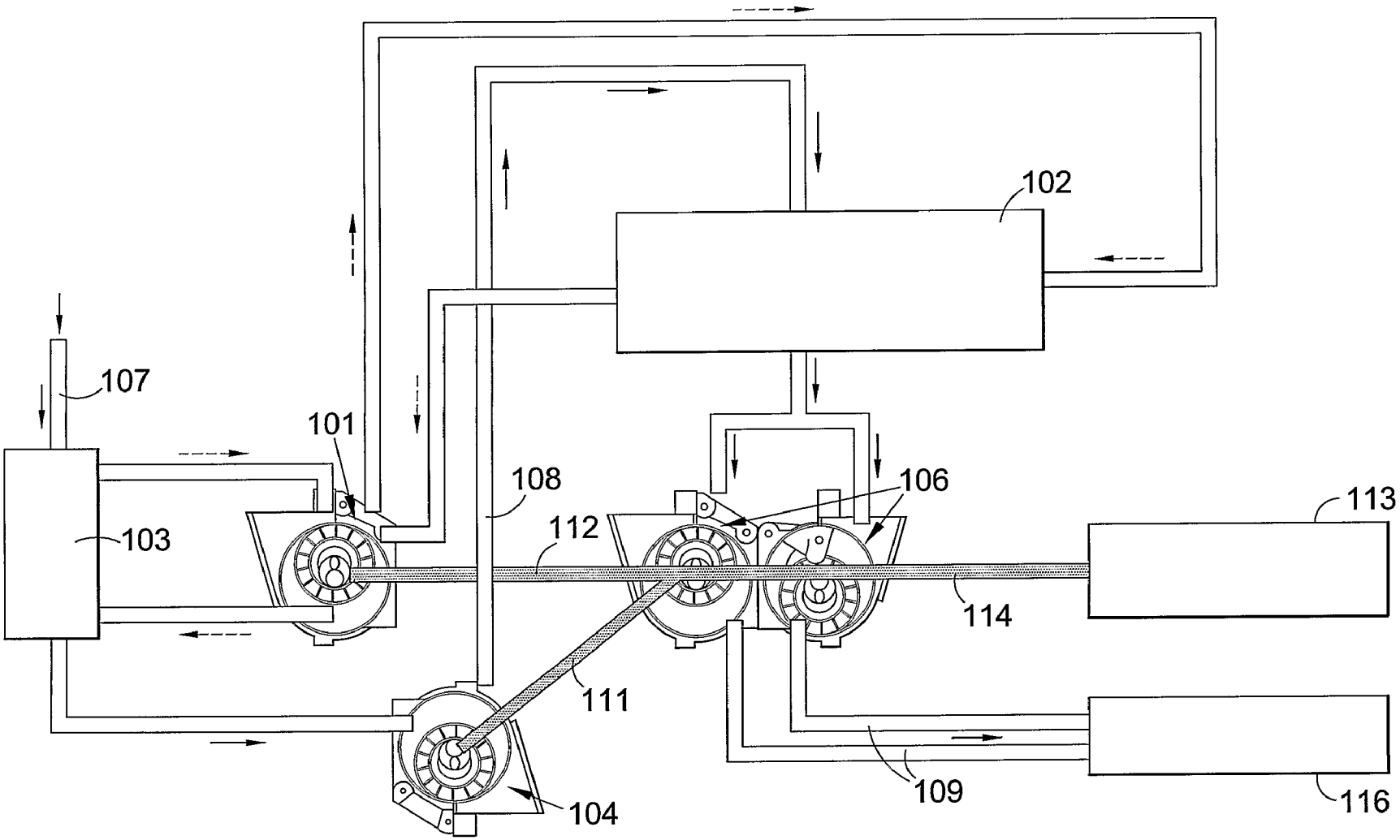
FIG. 1 is a diagrammatic representation of the layout of an engine according to the invention, in a first embodiment.
Figure 2:
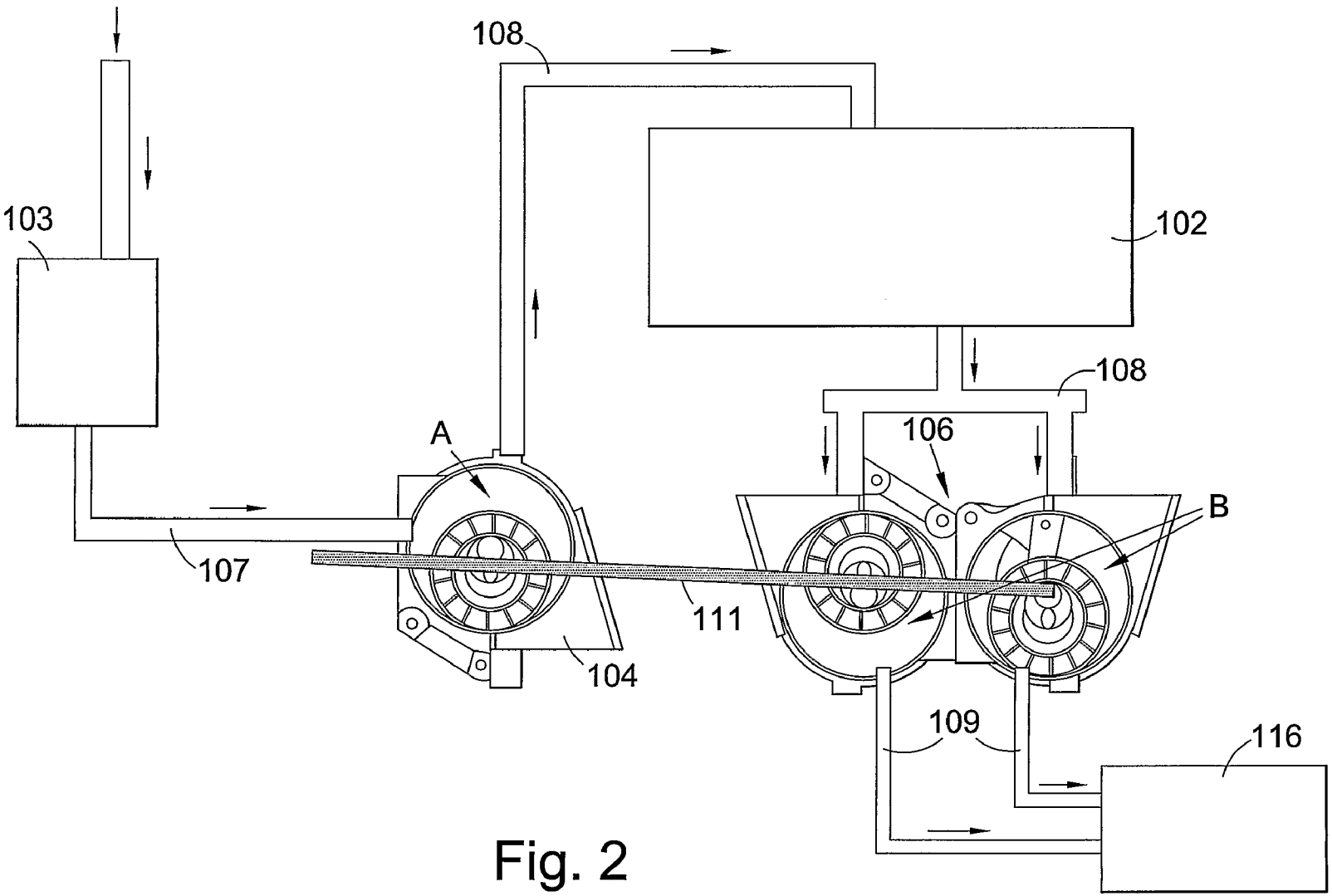
FIG. 2 shows part of the layout of the first embodiment, on an enlarged scale.

A first embodiment of an engine is shown diagrammatically in FIGS. 1 and 2. It includes a heat pump comprising a circuit in which a suitable refrigerant circulates as indicated by the broken arrows. The heat pump circuit includes a combined compressor/expander 101 (each constituted by a rotary positive displacement machine with an orbiting piston), a condenser 102, and an evaporator 103. The condenser 102 serves as a heater and the evaporator 103 serves as a cooler for a Sterling engine including a first rotary positive displacement machine 104 with one orbiting piston and a second rotary positive displacement machine 106 with two orbiting pistons.

An inlet duct 107 for atmospheric air leads through the evaporator 103 (heat exchanger) to the first positive displacement machine 104. An intermediate duct 108 leads from there, through the condenser 102 (heat exchanger), and branches before arriving at the second positive displacement machine 106. The machines 104 and 106 are linked by a suitable kinematic connection 111, which may comprise at least one shaft, a belt or chain, or gears, for example. The second machine 106 is linked to the compressor/expander 101 by a suitable kinematic connection 112 and to an electrical generator/motor 113 (or a power offtake) by a suitable kinematic connection 114. A double outlet duct 109 leads from the second positive displacement machine 106 to a hot exhaust or heat exchanger 116.

Air enters the evaporator 103 and evaporates the refrigerant for the heat pump compressor 101 to compress and pass to the condenser 102. Condensed refrigerant passes back from the condenser 102 to the heat pump expander 101 for expansion and return to the evaporator 103. After passing through the evaporator 103 some or all the inlet air passes to the orbiting piston in the cold part 104 of the Stirling engine and the orbiting piston transfers the cold air via the hot condenser 102 to the orbiting pistons in the hot part 106 of the Stirling engine. As the cold air rises in temperature as it passes through the condenser 102, it rises in pressure. Pressure energy is expanded by the hot orbiting pistons and exhausted to provide heating.

With reference to FIG. 2, volume 'A' associated with the cold orbiting piston is equal to half of each of the two volumes 'B' of the two hot orbiting pistons. As the cold piston rotates the two hot pistons rotate a proportionate amount (about half). Cold air passing through the condenser 102 to the hot pistons rises in temperature and pressure. The pressure is felt equally by the hot and cold pistons but in one case the piston is being driven and in the other the piston is driving; the net result is little or no energy is used in the transfer from cold to hot side of the Stirling engine. Each of the hot pistons receives the volume of volume 'A' of the cold rolling piston. The remaining proportion of volume 'B' of the hot pistons is used to expand the hot air. The hot pistons roll 180° out of phase, as shown in FIG. 2, and sequentially receive the volume discharged from volume 'A'. The exhausted but still hot air from the hot pistons is used to provide heating. The energy extracted from the expanding air drives the heat pump and any remaining energy may provide electrical or mechanical energy.

Figure 3:
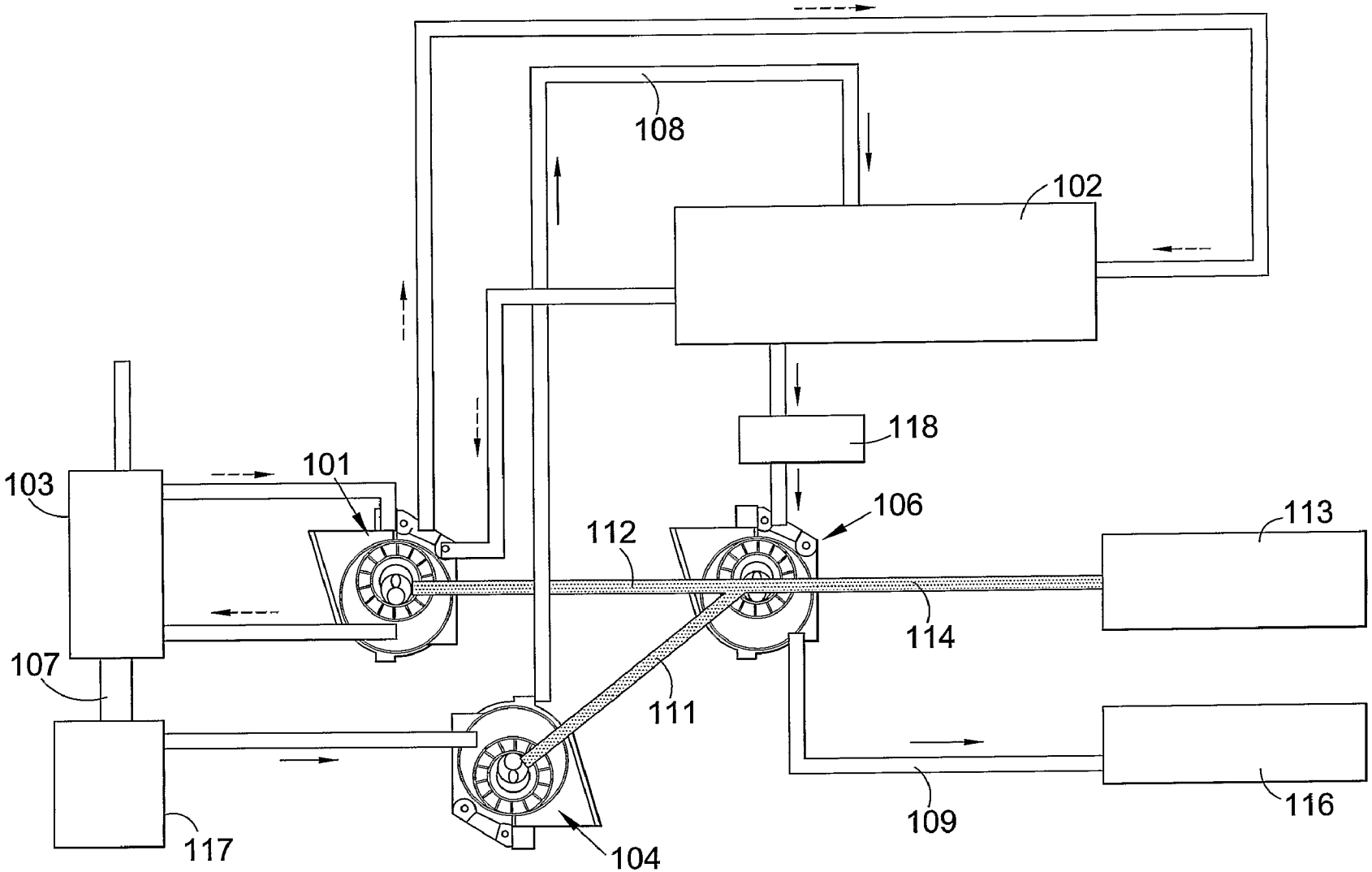
FIG. 3 is a diagrammatic representation of the layout of a second embodiment according to the invention.
Figure 4:
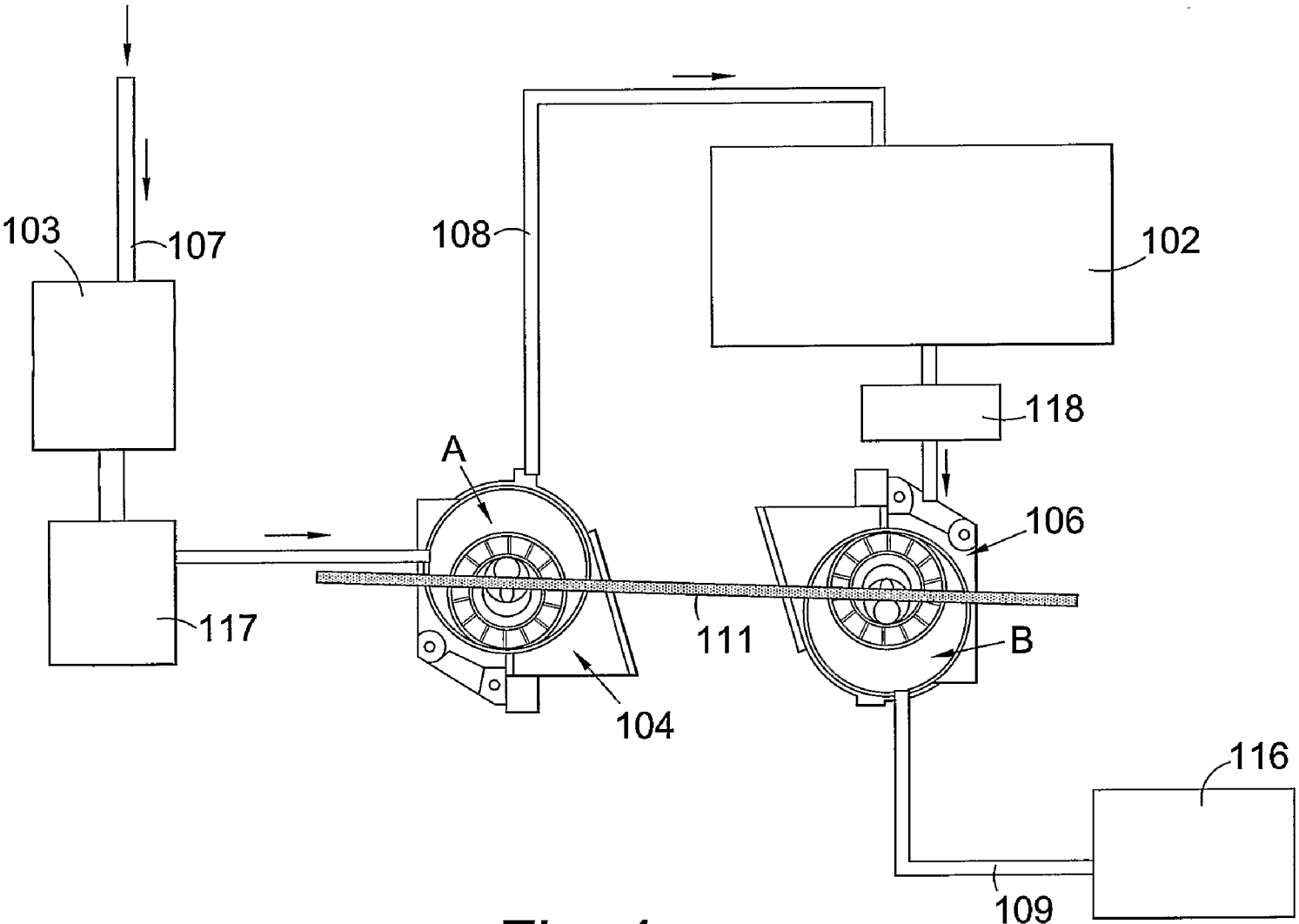
FIG. 4 shows part of the layout of the second embodiment, on an enlarged scale.
Figure 5:
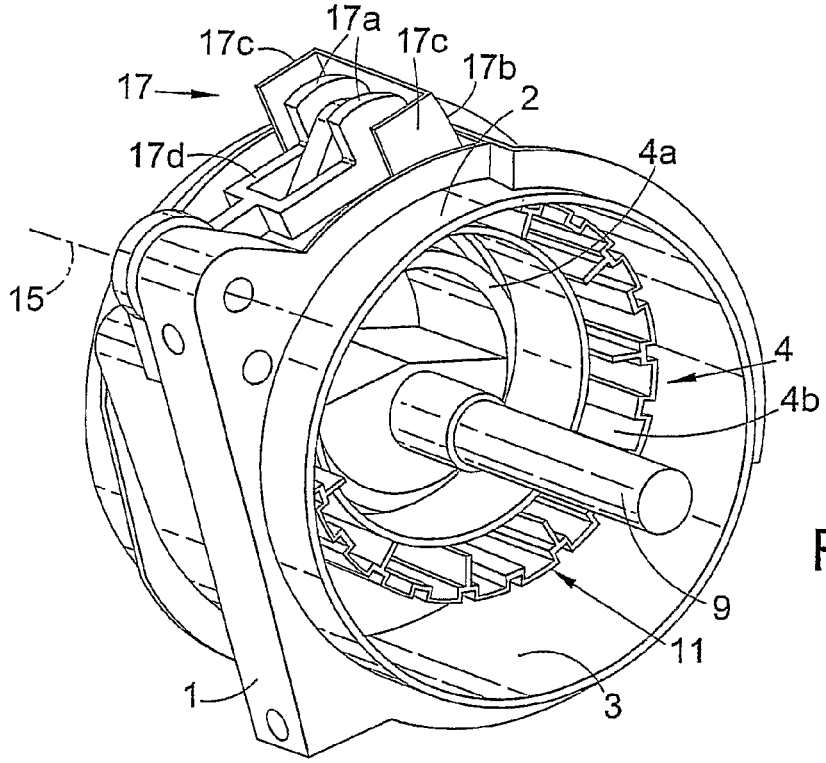
FIG. 5 is a perspective view of a rotary displacement machine, with parts omitted.
Figure 6:
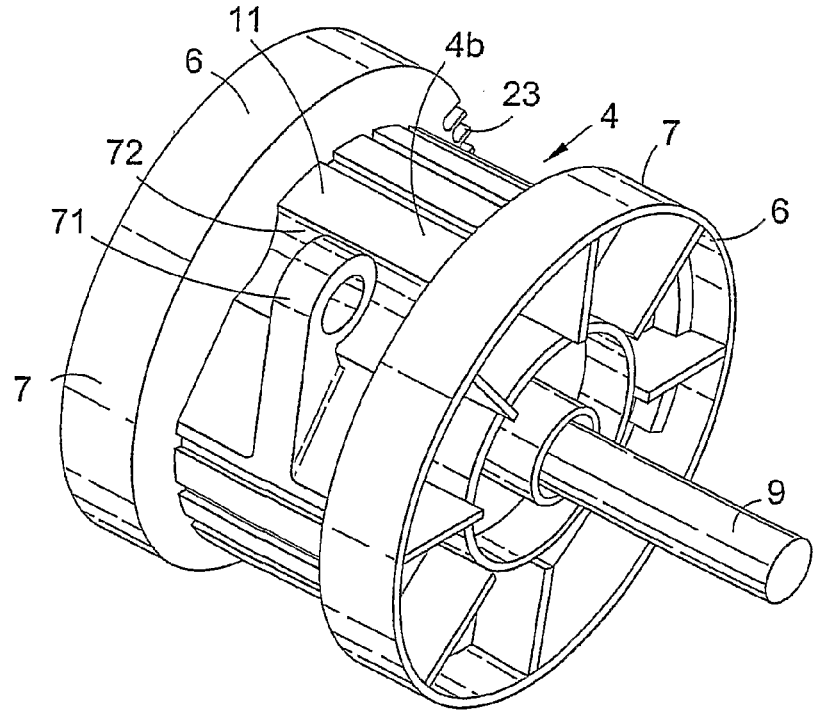
FIG. 6 is a perspective view of an orbiting piston and rotary side discs of the machine shown in FIG. 5.
Figure 7:
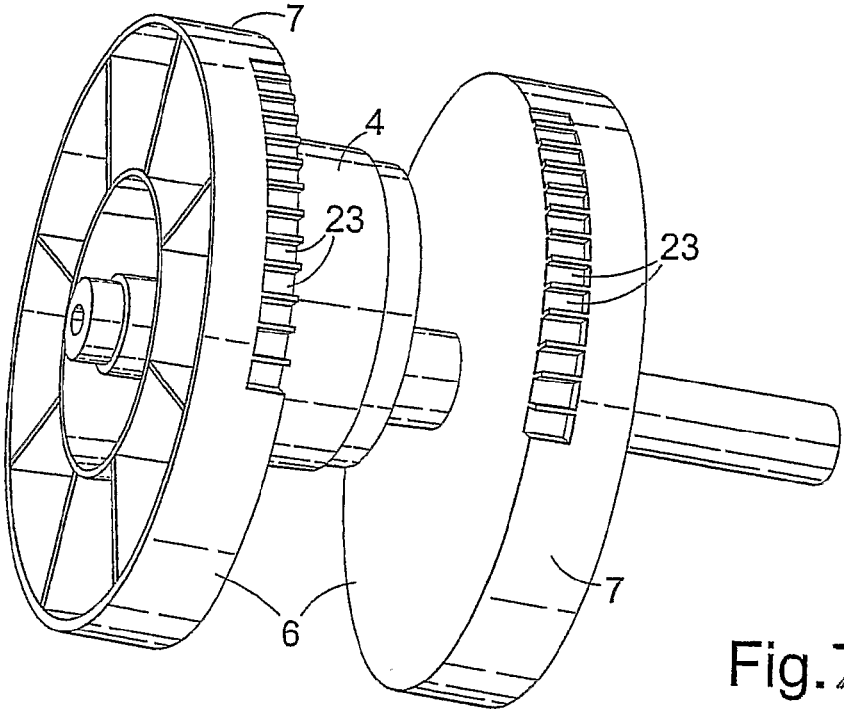
FIG. 7 is a perspective view of the side discs and the rotary inner part of the orbiting piston.

To extend the range over which the above combinations can provide heating and to be able to provide more efficient cooling when required, the following modifications are desirable and are shown diagrammatically in FIGS. 3 and 4. In FIG. 3 the hot side positive displacement machine 106 is changed from two to one orbiting piston to provide a closer matching of volumes between the cold and hot sides. The rotational speed of the hot piston to be the same or near the same as the rotational speed of the cold piston. A proportion of the rotation of the hot piston is the expansion phase of the Stirling cycle engine. If the volumes were equal the proportion of the orbit of the hot piston which was expansion would be equal to the proportion of the displacement of the cold piston that would need to be diverted into the heating system. To reduce the losses caused by a mismatch between volumes, the proportion of expansion by the hot piston, and the size of the hat pump, the speed and volume relationship between the hot and cold pistons will be made to suit the design point for heating at 116 or cooling at 117.

As the ambient temperature falls the above system quickly becomes impractical, and as the ambient temperature rises a point is reached where only cooling is required. To extend the range over which it is practical to provide heating, a supplementary heater 118 is provided to heat the air before entering the hot side piston. The heater 118 may provide heat by anything known in the art, but probably most conveniently by electricity or gas.

Under conditions where cooling is required the system is designed such that the mass of air used to evaporate the refrigerant in the evaporator 103 is more than the mass of air taken by the Stirling cycle engine, the difference is the mass of air available for cooling at 117.

Under cold conditions an external source of mechanical energy will be required to supplement the Stirling cycle engine power. This is most conveniently provided by changing the electrical generator to a motor at 113. Under these conditions the system will not generate electricity.

With reference to FIG. 4, volume 'A' associated with the cold piston is equal or near equal in volume to the volume 'B' of the hot piston. As the cold piston rotates the hot piston rotates the same or nearly the same amount. Cold air passing through the condenser 102 to the hot piston rises in temperature and pressure. The pressure is felt equally by the hot and cold pistons but in one case the piston is being driven and in the other the piston is driving; the net result is little or no energy is used in the transfer from cold to hot side of the Stirling cycle engine. The hot piston receives the volume output of 'A' of the cold piston. A proportion of volume 'B' of the hot piston is used to expand the hot air. The hot piston rolls in phase with the cold piston. The exhausted but still hot air from the hot piston is used to provide heating. The energy extracted from the expanding air drives the heat pump and any remaining energy may provide electrical or mechanical energy.

A proportion of the hot piston's rotation is used for expanding the hot fluid. At the start of expansion a rotating side disc, described below, shuts off the supply from the cold piston and diverts the proportion left in the cold piston, which passes from the cold piston and through the condenser, and away from the hot piston to provide heating. After expansion of the fluid by the hot piston the fluid is exhausted to provide heating.

Under falling ambient temperatures the electrical and heating output falls and a point is reached when additional mechanical energy is required to drive the heat pump; this is most conveniently provided by changing the generator to a motor at 118. Additional mechanical energy may be provided by the heater 118 between the condenser 102 and the hot piston to additionally heat the working fluid. This increases the fluid pressure and temperature and permits more expansion work and more heating from the exhausted fluid.

As the ambient temperature falls the heat output and COP (coefficient of performance) fall. At high temperature no energy other than that available from ambient conditions is required, but at low temperatures some conventional mechanical energy is required to supplement the energy provided by the Stirling cycle engine. However, the COP at low temperatures is significantly high. COP is defined as heating or cooling energy delivered divided by net energy needed to drive the heat pump. Net energy is defined as energy to drive the heat pump minus Stirling cycle engine mechanical power.

By way of example, ambient air is the working fluid and primary energy source. When the primary energy source is some other form such as water, the cooling supply at 117 becomes a heat exchanger, where the cold exit water from the evaporator 103 is used to cool the air supplied to the Stirling cycle engine and for cooling purposes.

It has been discovered that when the amount of heat energy supplied to the heat pump is about 20% of the heat energy provided by the heat pump, the heat pump is able to provide sufficient energy to a Stirling engine that incorporates rolling pistons, to enable the Stirling engine to provide sufficient power to drive the heat pump.

The energy source for the heat pump is any source known in the art such as gas, waste heat, air, water, earth or geothermal. When the source is air, and the heat pump and Stirling engine have reached operational speed, heat and electrical or mechanical output from the combination is available without the need to supply any other form of energy. All useful energy provided in this manner is equal to the reduction in source air temperature multiplied by the specific heat and mass of air.

Suitable positive displacement machines for use in the above-described engine will be described below.

The type of rotary positive displacement machine which is shown in FIGS. 5 to 8 is more fully described in WO 03/062604 and WO 2004/031539. It comprises a casing 1 with a peripheral wall 2 having a circular cylindrical internal surface 3. An orbiting piston 4 (also referred to as a rolling piston) comprises a rotating inner part 4*a*, eccentrically mounted on an input/output drive shaft 9 and carrying at each end a shutter in the form of a flange or disc 6, and a non-rotating outer part 4*b* which orbits about the axis of the internal surface 3. The outer part 4*b* of the orbiting piston 4 has a circular cylindrical external surface 11, one generatrix is spaced from the internal surface 3.

A vane member 17 is accommodated in an aperture in the casing 1 and this aperture can function as a fluid inlet/outlet. The vane member 17 has passageways 17*a* communicating between the exterior of the casing 1 and the operating chamber, an arcuate end wall 17*b*, transverse walls 17*c* extending from the respective ends of the end wall 17*b*, a forked arm 17*d* which is pivotally mounted on the casing 1 (pivot axis 15), and a tip face (not visible) which is a sealing surface with respect to a recess 72 in the external surface 11 of the orbiting piston 4. A fixed appendage 71 to the outer part 4*b* is connected to the arm 17*d* by a bearing (not visible) at a position between the pivot axis 15 of the vane member 17 and its arcuate end wall 17*b*.

Each end disc 6 has a circular cylindrical periphery 7 with only a small clearance between itself and the internal surface 3 of the casing 1. Each disc 6 has fluid inlet/outlet passages 23 for communicating between the operating chamber and openings (not shown) in the casing.

Figure 8:
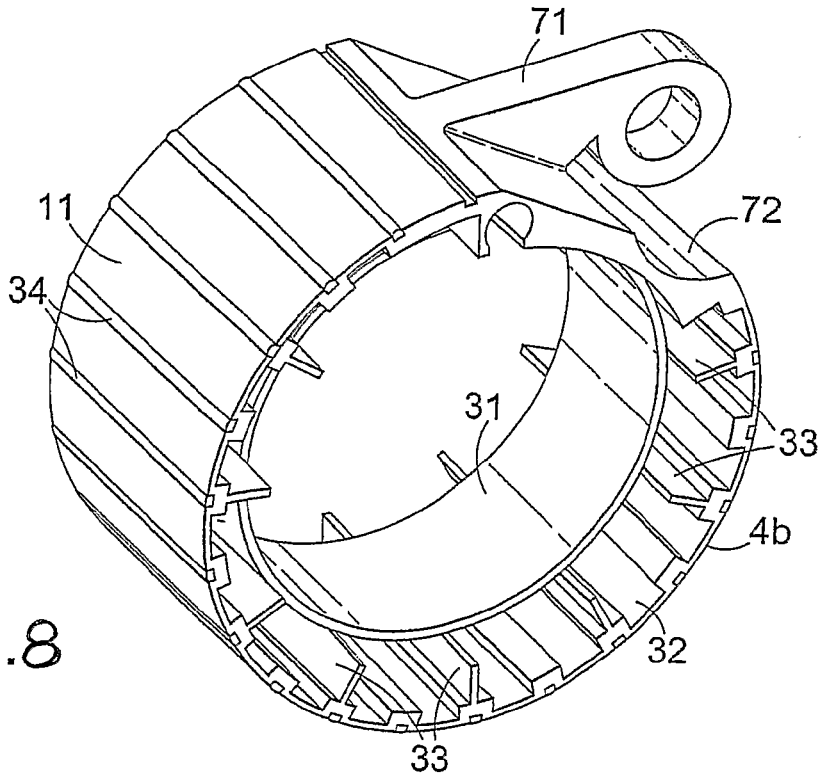
FIG. 8 is a perspective view of the outer part of the orbiting piston.
Figure 9:
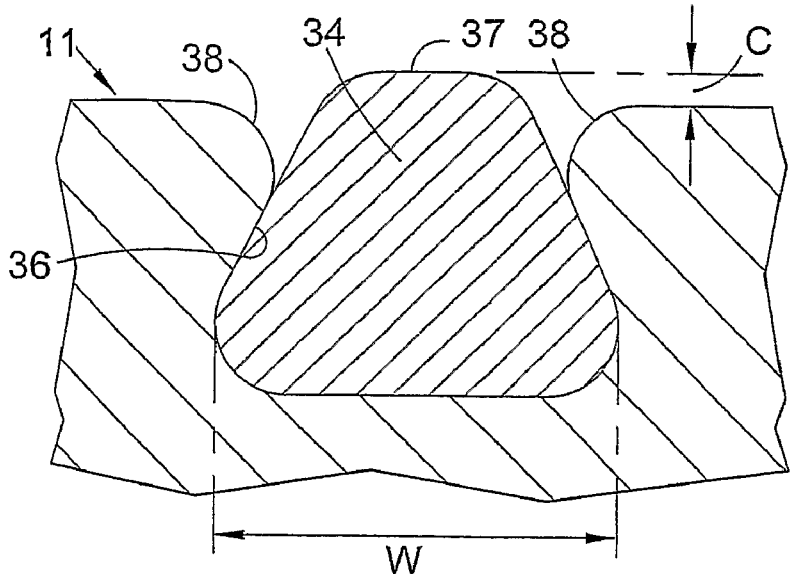
FIG. 9 is an enlarged cross-section through a compliant strip at the external surface of the orbiting piston.

The outer part 4*b* of the orbiting piston 4 (as best seen in FIG. 8) comprises an extruded body consisting of an inner shell 31 and an outer shell 32 connected by integral struts 33. The extruded body may be of light metal, e.g. an aluminium alloy.

The outer part 4*b* of the orbiting piston 4 is provided with a plurality of compliant strips 34 extending in the axial direction and being equally spaced apart. Each strip 34 is made of an elastomer, e.g. Viton or butyl rubber, and is mounted in a groove 36. The strip 34 narrows in a radially outward direction, having a cross-section which is a dovetail shape or, more precisely, a trapezium with round corners. The groove 36 widens in a radially inward direction and has a cross-sectional shape corresponding to that of the strip 34. The overall width W of the groove 36 is, for example, 4 mm. The strip 34 has a land 37 at a level at a distance C, preferably 0.2 mm or less (e.g. 0.1 mm), above the surface 11. The edges 38 of the groove 36 are chamfered, in particular rounded, so that the cross-sectional area of the groove 36 is equal to or greater than the cross-sectional area of the strip 34.

As the orbiting piston 4 orbits, the piston performs a rolling motion relative to the casing 1 and the strips 34 successively come into sliding contact with the internal surface 3 of the casing 1 and are compressed. There is at least one strip 34 in contact with the surface 3 over the majority of the orbit. For example, if the diameter of the surface 3 is 150 mm and the diameter of the surface 11 is 125 mm, the provision of about 18 strips 34 can ensure that two strips 34 are in contact with the surface 3 over the majority of the fluid compression or expansion phase. As the compliant strip 34 is compressed the displaced material is squeezed into the spaces left by the chamfered edges 38 of the groove 36 (more into the trailing space than the leading space).

Figure 10:
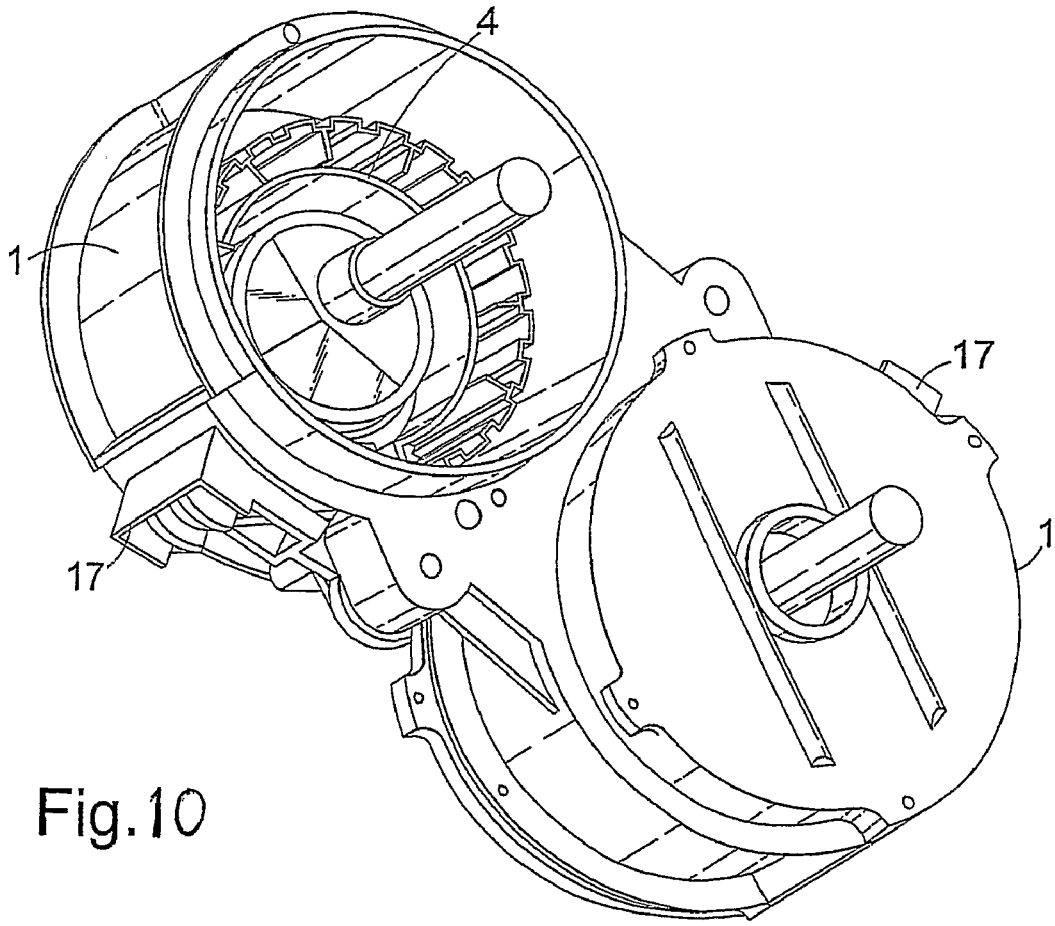
FIG. 10 is a perspective view of an assembly of two machines, viewed from one side, with parts of one machine omitted.
Figure 11:
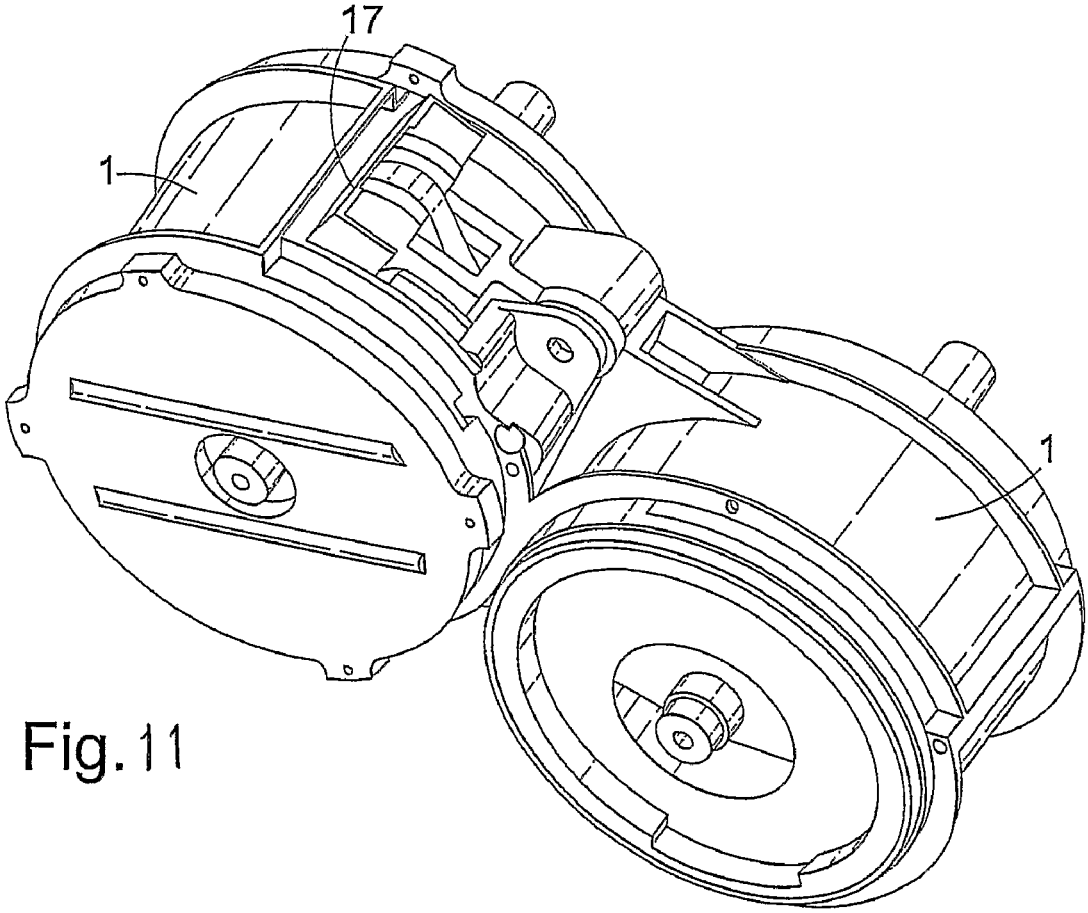
FIG. 11 is a perspective view of the assembly from the other side.

FIGS. 10 and 11 show two machines arranged in parallel, with their casings omitted. One machine functions as the compressor and the other as the expander of the above-mentioned heat pump; alternatively, they may function as the second positive displacement machine 106 in the first embodiment described with referent to FIGS. 1 and 2. In this arrangement the reciprocating forces caused by the eccentric motions of the two machines can be balanced. If two orbiting piston machines are fitted end-to-end and one is designed to balance the out-of-balance forces of the other, there will still be an out-of-balance couple. This can be substantially eliminated by fitting a counter-balance weight to the side of one machine remote from the other.

Figure 12:
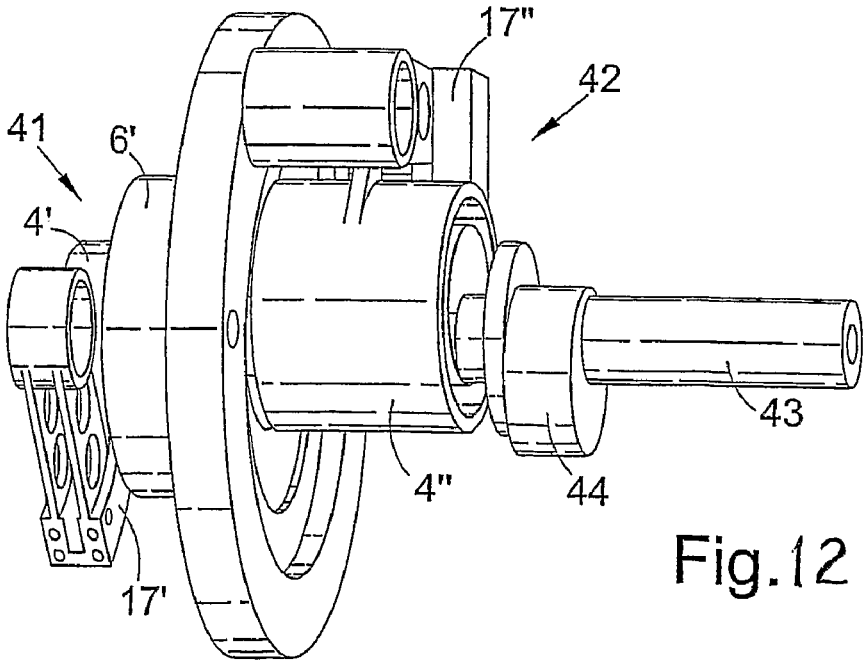
FIG. 12 is a perspective view of an expander attached to a compressor, with the outer casings removed.

FIG. 12 shows an expander 41 attached to a compressor 42 and having a common drive shaft 43. The outer casings have been removed. The expander 41 is an orbiting piston machine of the type described above, with an orbiting piston $\mathbf{4}^1$, a vane member $\mathbf{17}^1$, and a single rotating side disc $\mathbf{6}^1$ (although it is also possible to use two side discs, one on each side of the orbiting piston $\mathbf{4}^1$). The compressor 42 also has an orbiting piston $\mathbf{4}^{11}$ and a vane member $\mathbf{17}^{11}$ but no rotating side discs (fluid inlet and outlet being through the casing). A counter-balancing weight 44 is provided eccentrically on the shaft 43 to the side of the compressor 42 remote from the expander 41. The arrangement functions as the combined compressor/expander 101 described above (FIGS. 1-4).

Various modifications may be made in the above-described embodiments. For instance, the expander in the heat pump circuit may be an expansion valve (fixed or adjustable) instead of a rotary positive displacement machine.

The invention claimed is:

1. An engine comprising:

a first positive displacement machine;

a second positive displacement machine;

an inlet duct connected to the first positive displacement machine;

an intermediate duct connected between the first and second positive displacement machines;

an outlet duct connected to the second positive displacement machine;

a heater for raising the temperature and pressure of a gaseous working fluid in the intermediate duct; and a kinematic connection between the first and second positive displacement machines;

the arrangement being such that, in operation of the engine, the first positive displacement machine causes a volume of the working fluid to flow through the intermediate duct to the second positive displacement machine, the heated and pressurized volume of working fluid drives the second positive displacement machine, and the second positive displacement machine drives the first positive displacement machine via the kinematic connection;

the positive displacement machines including at least one orbiting piston, wherein the heater causes the working fluid pressure to rise equally in the first and second positive displacement machines, such that substantially no energy is required in the transfer of working fluid from the first positive displacement machine to the second positive displacement machine.

2. An engine as claimed in claim 1, in which the second positive displacement machine includes two orbiting pistons in parallel, with a 180° phase difference between them.

3. An engine as claimed in claim 1, further comprising a generator and a kinematic connection between the second positive displacement machine and the generator.

4. An engine as claimed in claim 1, further comprising a motor and a kinematic connection between the motor and the second positive displacement machine.

5. An engine as claimed in claim 1, further comprising a heat exchange connected to the outlet duct so as to receive heat from the working fluid exhausted by the second positive displacement machine.

6. An engine as claimed in claim 1, in which the working fluid is air.

7. An engine as claimed in claim 6, in which the inlet duct receives air from the atmosphere, directly or indirectly.

8. An engine as claimed in claim 6, in which the outlet duct discharges air to the atmosphere, directly or indirectly.

9. An engine as claimed in claim 1, further comprising a heat pump circuit including, in sequence, a compressor, a condenser which constitutes at least part of the said heater, an expander, and an evaporator.

10. An engine as claimed in claim 9, in which the compressor comprises a third positive displacement machine with an orbiting piston, there being a kinematic connection between the second positive displacement machine and the third positive displacement machine.

11. An engine as claimed in claim 10, in which the expander comprises a fourth positive displacement machine with an orbiting piston, there being a kinematic connection between the third and fourth positive displacement machines.

12. An engine as claimed in claim 9, in which the evaporator comprises a heat exchanger through which the said inlet duct passes to cool the working fluid supplied to the first positive displacement machine.

13. An engine as claimed in claim 12, further comprising a cooler through which the inlet duct passes downstream of the heat exchanger.

14. An engine as claimed in claim 9, further comprising a supplementary heater through which the intermediate duct passes downstream of the said condenser.

15. An engine as claimed in claim 1, in which at least one of the said positive displacement machines comprises:

a casing having a circular cylindrical internal surface delimiting an operating chamber;

an orbiting piston in the operating chamber, the orbiting piston being mounted so as to orbit about a chamber axis which is the axis of the said internal surface, the orbiting piston having a cylindrical external surface, the chamber axis passing through the orbiting piston, a generatrix of the external surface being adjacent to the said internal surface, and a diametrically opposite generatrix being spaced from the said internal surface;

a vane member mounted on the casing, the vane member having a tip face which faces the external surface of the orbiting piston and which has a length substantially equal to that of the orbiting piston; and a linkage which connects the vane member to the orbiting piston so as to keep the tip face of the vane member adjacent the external surface of the orbiting piston.

16. An engine, comprising:

a first positive displacement machine, connected to an inlet duct, including at least one orbiting piston;

a second positive displacement machine, connected to an outlet duct, including at least one orbiting piston;

an intermediate duct connected to the first and second positive displacement machines;

a kinematic connection linking the first and second positive displacement machines;

a heater for raising the temperature and pressure of a gaseous working fluid in the intermediate duct which causes the working fluid pressure to rise equally in the first and second positive displacement machines, such that substantially no energy is required in the transfer of working fluid from the first positive displacement machine to the second positive displacement machine; and a device that shuts off the supply of working fluid from the first positive displacement machine and diverts a proportion of the supply of working fluid away from the second positive displacement machine, wherein, in operation of the engine, the first positive displacement machine causes a volume of the working fluid to flow through the intermediate duct to the second positive displacement machine, the heated and pressurized volume of working fluid drives the second positive displacement machine, and the second positive displacement machine drives the first positive displacement machine via the kinematic connection.

17. An engine as claimed in claim 16, wherein the heater includes a condenser, and the proportion of the supply of working fluid diverted away from the second positive displacement machine is passed through the condenser for heating.

* * * * *